United States Patent [19]

Gugenberger et al.

[11] 4,044,825

[45] Aug. 30, 1977

[54] HEAT EXCHANGER FOR HIGH TEMPERATURE

[75] Inventors: René Gugenberger, Gif-sur-Yvette; Roger Martin, Paris, both of France

[73] Assignee: Commissariat a l'Energie Atomique, Paris, France

[21] Appl. No.: 646,548

[22] Filed: Jan. 5, 1976

[30] Foreign Application Priority Data

Jan. 6, 1975 France ..... 75.00264

[51] Int. Cl.[2] ..... F28F 9/00

[52] U.S. Cl. ..... 165/165

[58] Field of Search ..... 165/164, 165, 9.1, 9.2, 165/9.3, 9.4

[56] References Cited

U.S. PATENT DOCUMENTS

| | | | |
|---|---|---|---|
| 2,821,369 | 1/1958 | Hilliard | 165/164 |
| 2,887,304 | 5/1959 | Hilliard | 165/165 |
| 3,250,322 | 5/1966 | McCrary, Jr. et al. | 165/164 |

FOREIGN PATENT DOCUMENTS

| | | | |
|---|---|---|---|
| 1,078,868 | 8/1967 | United Kingdom | 165/165 |

*Primary Examiner*—Carroll B. Dority, Jr.
*Assistant Examiner*—Theophil W. Streule, Jr.
*Attorney, Agent, or Firm*—William D. Stokes

[57] ABSTRACT

The heat exchanger is constituted by a stack of blocks forming the heat-exchanger body and the connecting end components, ducts for the circulation of primary and secondary fluids being bored in the blocks. Each end block has at least two surfaces which are inclined with respect to each other and into which open the primary and secondary ducts respectively. The surfaces are joined together and support a member which provides a separation between the primary and secondary fluids.

9 Claims, 4 Drawing Figures

HEAT EXCHANGER FOR HIGH TEMPERATURE

This invention relates to a heat exchanger for high temperatures.

It is already known that a recommended practice in high-temperature operation consists in employing heat exchangers in which the primary and secondary ducts are arranged in a stack of blocks, preferably of graphite.

However, heat exchangers of this type which were designed prior to the present invention are low-power units having complex structures, in particular for distributing primary and secondary fluids within the appropriate ducts or collecting said fluids as they are discharged from said ducts.

In consequence, these heat-exchangers can be employed only in a limited number and in certain applications. They cannot be employed when it is desired, for example, to transfer the maximum quantity of heat stored by the coolant fluid of a high-temperature nuclear reactor to another fluid in order to carry out certain chemical operations. The reason for this is that, in such a case, the complete heat-exchanger unit which has a sufficient power output has to be housed within a small space formed within the concrete reactor containment structure and that the heat exchanger must be provided with coaxial inlet and outlet ducts.

The present invention is precisely directed to a heat exchanger for high temperatures which remains of small overall size even in the case of high power outputs.

Moreover, in keeping with the novel design concept of the heat exchanger, different geometrical forms may be contemplated and one preferential form complies with the two conditions mentioned above (high power and coaxial ducts) for the application which is desired.

The heat exchanger in accordance with the invention is constituted in known manner by a stack of blocks which form on the one hand the heat-exchanger body proper and on the other hand the connecting end components, the primary and secondary ducts being bored in said blocks, and is distinguished by the fact that each end block of said heat exchanger has at least two surfaces which are inclined with respect to each other and into which open the primary and secondary ducts respectively, said surfaces being joined together and adapted to support a member which provides a separation between the primary and secondary fluids.

Said heat exchanger has an advantage in that a large number of ducts can be provided in respect of a small overall volume since the end components have a particular structure which corresponds to the blocks of the heat-exchanger body and consequently permit straightforward separation of the primary and secondary fluids at both ends of said heat exchanger irrespective of the number of ducts provided.

By reason of the arrangement of the body and the end components of the heat exchanger, good occupation of the total volume of graphite is obtained by means of an arrangement in parallel layers of ducts which are parallel to the longest dimension of the heat exchanger within the blocks of the body and are inclined with respect to said longest dimension within the blocks of the end components, either the primary fluid or the secondary fluid being circulated within each duct layer aforesaid in an alternate arrangement of said layers.

In accordance with a preferential alternative embodiment, the heat exchanger according to the invention can comprise two end components which are designed in the shape of a "crater" and are associated with a cylindrical body.

The alternative embodiment aforesaid has the advantage of permitting admission and discharge of the primary and secondary fluids through coaxial ducts, thus making its use possible and wholly satisfactory in a high-temperature reactor.

The following description relates to examples of construction of the heat exchanger in accordance with the invention which are given by way of illustration but not in any limiting sense as well as to one example of utilization of said heat exchanger in a high-temperature reactor, reference being made to the accompanying drawings, in which.

Figure 1:
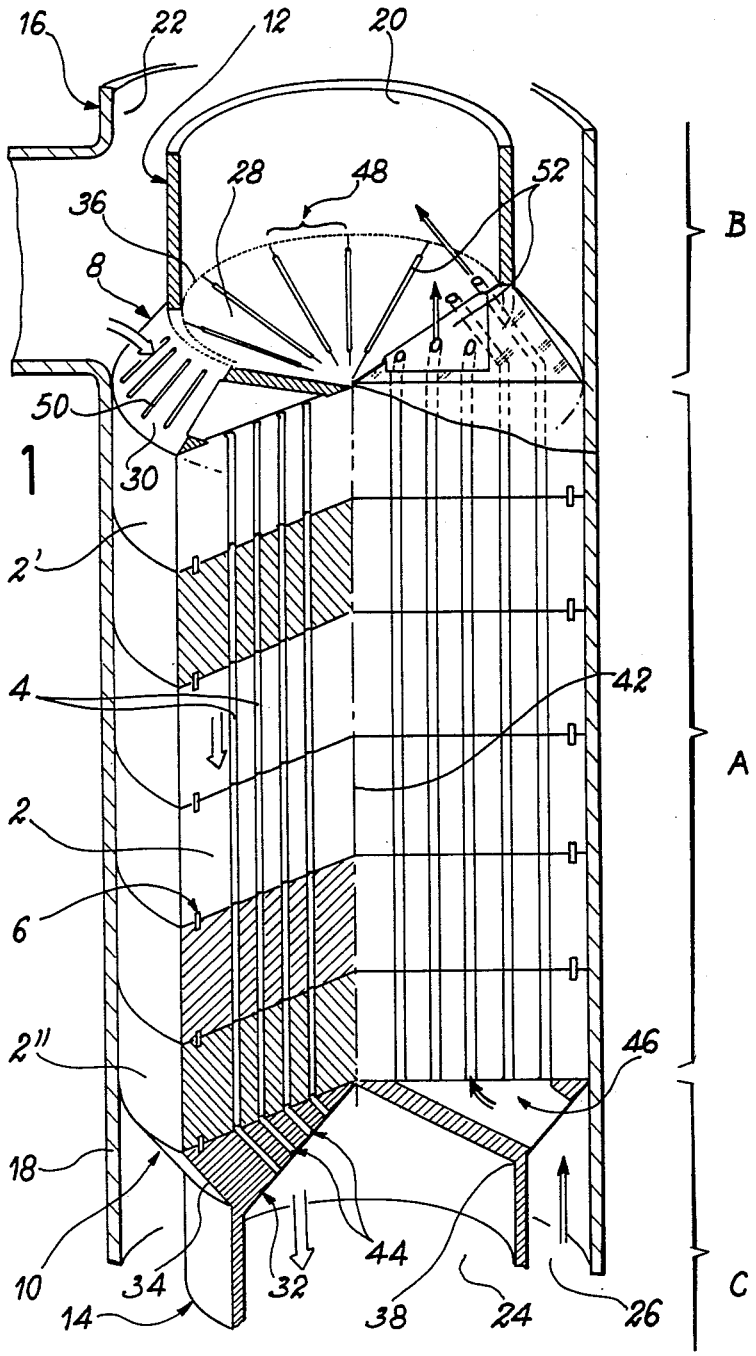
FIG. 1 is a diagrammatic part-sectional view in perspective showing a heat exchanger of cylindrical shape having a circular base and provided with coaxial ducts for the admission and discharge of fluids.

In the heat exchanger which is illustrated diagrammatically in FIG. 1, there is shown the body A of the heat exchanger comprising cylindrical blocks having a circular base such as the block 2 in which are bored a large number of ducts such as the duct 4. Said blocks 2 are stacked one above the other and centered by means of keys 6 in order to ensure continuity of each of the ducts 4 from one block to the next. The end components B and C are shown at the two extremities of the heat exchanger. The end component B comprises the block 8 and the cylindrical shell 12 and the end component C comprises the block 10 and the cylindrical shell 14. Said shells 12 and 14 are mounted respectively above the blocks 8 and 10 so as to define with the shells 16 and 18 having the same axis the two sets of coaxial ducts 20, 22 and 24, 26 for the admission or discharge of each of the fluids.

In accordance with the essential feature of the invention, the blocks 8 and 10, the bases of which are adjusted with respect to the end blocks 2' and 2'' of the heat-exchanger body A each have two surfaces 28 and 30 in the case of the block 8 and two surfaces 32 and 34 in the case of the block 10 which are inclined with respect to each other and joined together along circumferences 36 and 38. By virtue of the cylindrical shape and circular base of the blocks 2 of the heat-exchanger body, the surfaces 28 and 30 of the block 8 are portions of cone such that the fictitious vertices are located on each side of the plane of the circumference 36 which defines the intersection of said surfaces and the same applies to the walls 32 and 34 of the block 10.

Each duct 4 passes through the blocks such as 2 of the heat-exchanger body A, is extended within the blocks 8 and 10 and arranged within said blocks so as to open in the walls of either the block 8 or the block 10, depending on whether primary or secondary fluid is circulated within said duct.

In order to minimize pressure drops, it is found preferable to adopt an arrangement in which the ducts 4 are rectilinear within the entire heat-exchanger body A, said ducts being parallel to the axis 42 of the heat exchanger within said body A. There is thus an interruption of slope of the ducts only as these latter pass through the body A into the end components B or C in which said ducts are inclined with respect to said axis 42.

Moreover, in order to provide the heat exchanger with a large number of ducts without increasing the size of these latter, said ducts 4 are preferably arranged in layers through which the primary or secondary fluid is circulated alternately. Two layers 44 and 46 through which the primary and secondary fluids are circulated respectively are shown in the section planes of FIG. 1. It is apparent that the ducts of the layer 44 which carry a circulation of primary fluid, for example, start from the external wall 30 of the block 8 and terminate in the internal wall 32 of the block 10 whilst the ducts of the layer 46 which accordingly carry a circulation of secondary fluid start from the external wall 34 of the block 10 and terminate in the internal wall 28 of the block 8.

It is worthy of note that a group of duct layers can be supplied with primary or secondary fluid through walls such as 28 and 32 which are both internal or external on each of the blocks 8 and 10 or through walls such as 30 and 34 which are internal in one of the blocks 8 or 10 and external on the other block.

It will be recalled that, when the dimensions required for the heat exchanger are of appreciable value, the blocks which constitute the heat-exchanger body or the end components can no longer be of single-piece construction but must be constituted by the arrangement of a certain number of sectors such as 48 which are interassembled in leak-tight manner by means of keys.

It will be noted in addition that the ducts which must be inclined with respect to the axis 42 can be more conveniently arranged within the end components by combining a certain number of ducts in a single elongated slot; this has been carried into effect in FIG. 1 in the case of the ducts constituting the layer 44 which accordingly open into the slit 50 formed in the external wall 30.

Also worthy of note is the fact that it is an advantage to increase the outlet surface area of the ducts which have their openings in the internal wall 28 by providing cavities 52 which are hollowed-out in said wall between two consecutive sectors 48.

Figure 2:
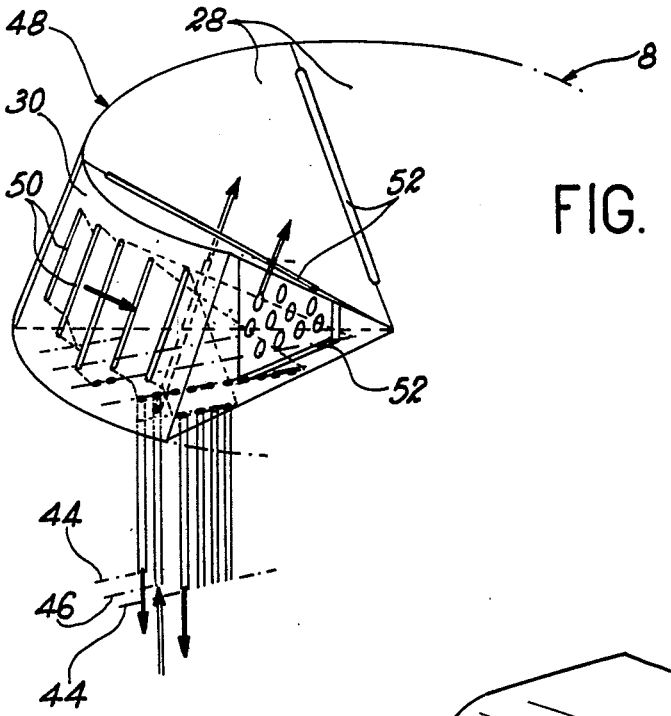
FIG. 2 is a partial view of one of the end components of a cylindrical heat exchanger having a circular base.

There is shown more precisely in FIG. 2 the top block 8 which is made up of a plurality of sectors 48. It can be seen that, in each sector, the ducts are arranged in layers which are parallel to their plane of symmetry in order to prevent any interference between primary and secondary layers.

The ducts of the layers such as 44 through which is circulated the primary fluid, for example, are united in a single narrow passageway within the block 8 and terminate in slits 50 formed in the wall 30.

The ducts of the layers 46 which are intercalated between two layers 44 have their individual openings in the sectors 48 of the wall 28 or in one of the faces of the cavities 52 which are formed between two consecutive sectors 48.

The operation of the heat exchanger which is described with reference to FIGS. 1 and 2 and in which the streams of primary and secondary fluids are in opposition is as follows:

From the time of admission into the heat exchanger, the primary fluid contained within the inlet duct 22 is distributed within the ducts which are assigned thereto since only these latter have their openings in the wall 30 of the blocks 8, the duct 22 being supported by said wall 30. After passing through the heat exchanger, the primary fluid is collected within the duct 24 which is integral with the wall 32 of the block 10, only the ducts through which said primary fluid is circulated being intended to have their openings in said wall.

In the case of the secondary fluid, the principle of distribution and collection is identical and takes place through the walls 34 and 28 of the end blocks which are connected respectively to the ducts 26 and 20.

The primary and secondary fluids are separated from each other in a reliable manner by means of the inner cylindrical shells 12 and 14.

Figure 3:
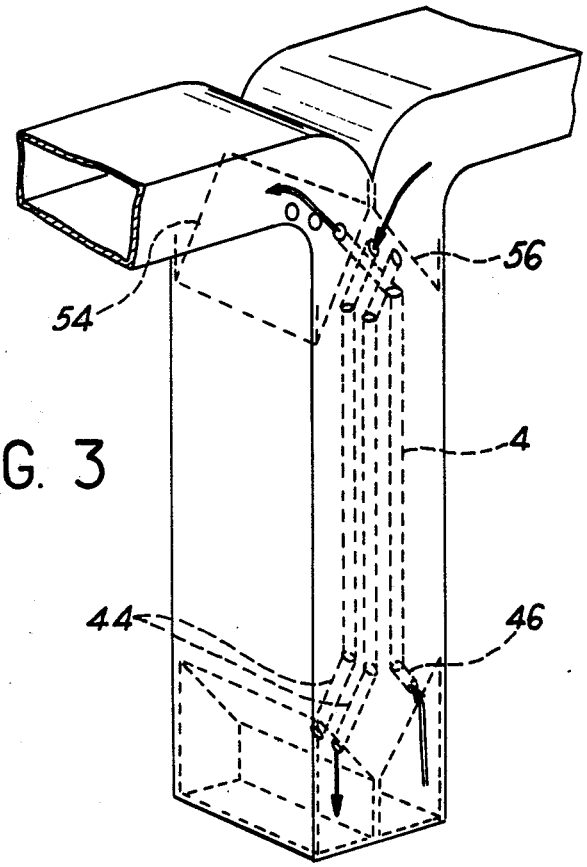
FIG. 3 is a perspective view showing a heat exchanger of parallelepipedal shape.

There is shown diagrammatically in FIG. 3 another alternative embodiment of the heat exchanger in the case of a parallelepipedal body, in which the end blocks each have two inclined rectangular walls such as 54 and 56. The arrangement of the ducts within the different blocks of the heat-exchanger body and the end components is similar in general conception to the arrangement described earlier in the case of a cylindrical heat exchanger.

In both alternative embodiments of the heat exchanger according to the invention, problems of leak-tightness between the primary and secondary ducts are solved by circulating within these latter primary and secondary fluids having the same nature while limiting pressure differences to the value of the pressure drops.

Moreover, it is an advantage to maintain the secondary fluid at a slight overpressure with respect to the primary fluid. The main object thereby achieved is that, when a heat exchanger of this type is employed in a nuclear reactor, migration of fission products from the primary ducts to the secondary ducts is accordingly prevented.

Furthermore, in order to remove any danger of leakage between two consecutive blocks, it is preferable to construct a heat exchanger of this type from graphite blocks which have been subjected to a number of different machining operations in order to facilitate perfect application of one of said blocks against those which support or surmount said block.

Again with a view to preventing any possible leakage between two blocks, it is also an advantage to provide not only a certain number of keys 6 but also elastic devices which are not located within the hot zone and can play a contributory part in applying the blocks one against the other.

Furthermore, in order to obtain satisfactory leak-tightness within the mass of the heat exchanger, it is advisable to subject the machined blocks to a number of different impregnation treatments with a view to reducing the porosity of the graphite.

Figure 4:
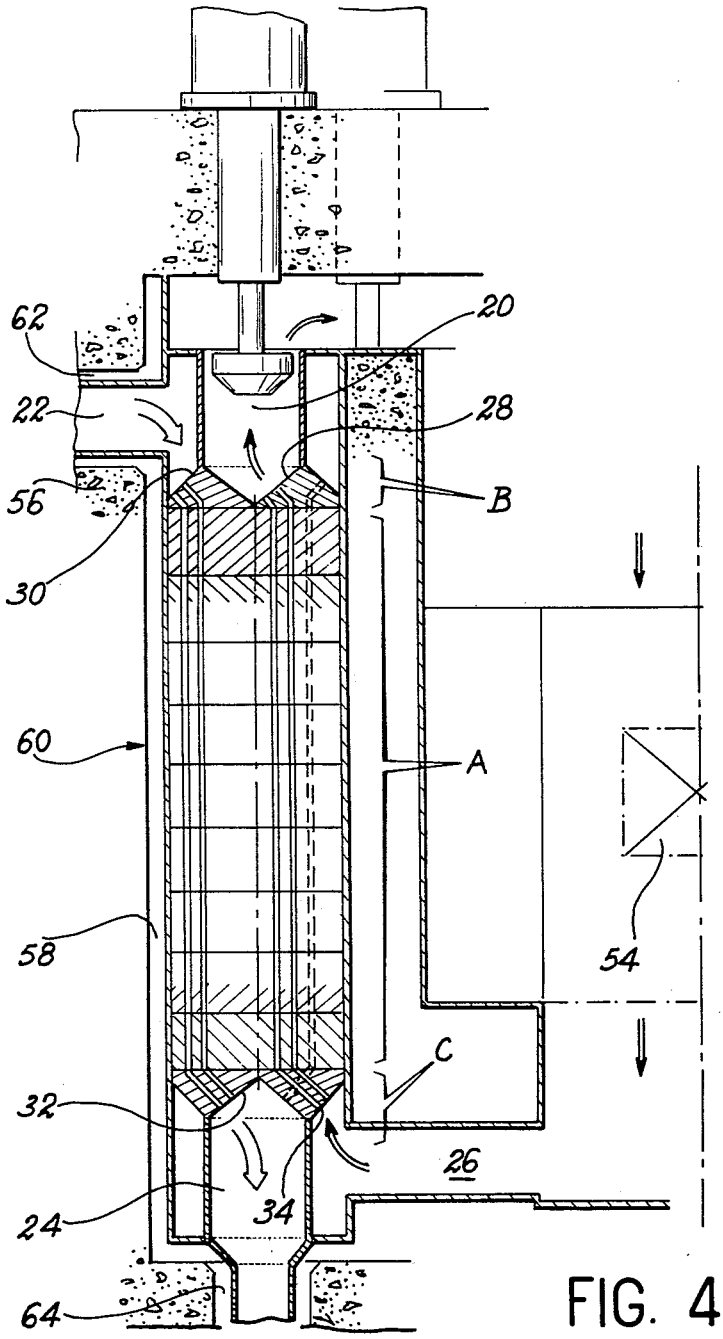
FIG. 4 illustrates the heat exchanger of FIG. 1 in a high-temperature reactor.

FIG. 4 shows a heat exchanger as constructed in accordance with the alternative embodiment represented diagrammatically in FIG. 1 to a high-temperature reactor which is cooled by compressed helium.

There can be seen in this figure the reactor core 54 which is placed within the concrete containment structure 56 and the heat exchanger 60 of the invention which is placed within one of the cavities 58 formed in the wall of said concrete containment structure 56.

The heat exchanger 60 is connected to the reactor core 54 by means of the ducts 26 and 20 which correspond respectively in the case of said exchanger 60 to the ducts for admission and discharge of the primary fluid constituted by the reactor coolant fluid.

The ducts 22 and 24 which traverse the wall of the concrete containment structure 56 respectively through the orifices 62 and 64 correspond respectively in the case of the heat exchanger 60 to the inlet and outlet ducts for the secondary fluid.

It is seen that, in the case of the heat exchanger 60 which is thus placed within the reactor, the primary ducts have their openings in the walls 34 and 28 of the end components C and B whilst the secondary ducts have their openings in the walls 30 and 32 of the end components B and C.

This diagram serves to establish the fact that the heat exchanger in accordance with the invention, of small overall size and provided with coaxial ducts, is particularly well suited to this type of application.

We claim:

1. A heat exchanger for the convection of heat between primary and secondary fluids circulating through the exchanger, comprising:

at least one heat exchange block having first and second parallel planar surfaces;

a first end member having a planar surface in sealing contact with said first parallel planar surface of said heat exchange block, and first and second inclined transverse surfaces opposite said planar surface;

a second end member having a planar surface in sealing contact with said second parallel planar surface of said heat exchanging block, and first and second inclined transverse surfaces opposite said planar surface;

means on said first end member separating said first inclined surface from said second inclined surface for forming a primary collecting duct associated with said first inclined surface and for forming a secondary collecting duct associated with said second inclined surface;

means on said second end member separating said first inclined surface from said second inclined surface for forming a primary collecting duct associated with said second inclined surface and for forming a secondary collecting duct associated with said first inclined surface;

first channel means for conducting primary fluid from said primary collecting duct of said first end member through said heat exchange block to said primary collecting duct of said second end member; and second channel means disposed in a heat convecting relationship with said first channel means and for conducting secondary fluid from said secondary collecting duct of said first end member through said heat exchange block to said secondary collecting duct of said second end member.

2. A heat exchanger according to claim 1 wherein said heat exchanger has a longest dimension extending from said first end member through the heat exchange block to said second end member and wherein said first channel means and said second channel means are parallel to said longest dimension within said heat exchange block and are inclined with respect to the longest dimension within said first end member and said second end member.

3. A heat exchanger according to claim 2 wherein said first channel means and said second channel means are arranged in respective alternating planes with respect to said longest dimension.

4. A heat exchanger according to claim 3 wherein said heat exchange block, said first end member and said second end member comprise an assembly of a predetermined number of sectors, each said sector including a plurality of said radial planes of said first channel means and said second channel means.

5. A heat exchanger according to claim 4 wherein intersection of said first channel means and said second channel means with said inclined surfaces of said first end member and said second end member comprise slots formed in said inclined surfaces and extending radially from said longest dimension.

6. The heat exchanger of claim 1 wherein said heat exchange block is parallelepipedal and said inclined surfaces of said first end member and said second end member are rectangular.

7. A high temperature heat exchanger for the convection of heat between a primary circulating fluid and a secondary circulatory fluid, comprising:

an exchanger body comprising a plurality of heat exchange blocks sealingly stacked along a longitudinal axis, each side block having opposite, parallel planar surfaces adapted for stacking, said exchanger body having a respective proximate and distal parallel surface at opposite ends of said axis;

a first end member having a planar surface in sealing contact with said proximate planar surface of said exchanger body and having at least two inclined surfaces opposite said planar surface;

a second end member having a planar surface in sealing contact with said remote planar surface of said exchanger body and having at least two inclined surfaces opposite said planar surface;

means on said first end member separating said inclined surfaces for forming a primary first end chamber and a secondary first end chamber, said first end chambers for respectively receiving a primary fluid and a secondary fluid;

means on said second end member separating said inclined surfaces for forming a primary second end chamber and a secondary second end chamber, said second end chambers for respectively receiving the primary fluid and the secondary;

means extending from said first end member through said exchanger body to said second end member for conducting primary fluid between said primary first end chamber and said primary second end chamber and for conducting said secondary fluid between said secondary first end chamber and said secondary second end chamber.

8. The heat exchanger of claim 7 and further including:

primary fluid inlet means for providing ingress of primary fluid into said primary first end chamber;

primary fluid outlet means for providing egress of primary fluid from said primary second end chamber;

secondary fluid inlet means for providing ingress of secondary fluid into said secondary first end chamber; and secondary fluid outlet means for providing egress of secondary fluid from said secondary second end chamber.

9. The heat exchanger of claim 8 wherein said means for conducting primary fluid and secondary fluid terminate in slots in said inclined surfaces of said first end member and said second end member, said slots disposed in radial planes with respect to said longitudinal axis.

* * * * *